US005452961A

United States Patent [19]

Lu

[11] Patent Number: 5,452,961

[45] Date of Patent: Sep. 26, 1995

[54] CLEANING APPARATUS WITH A CLEANING AGENT DISPENSING DEVICE

[76] Inventor: Tao-Jen Lu, No. 27, Lane 2, Yute Rd., North Dist., Taichung City, Taiwan, Prov. of China

[21] Appl. No.: 301,974

[22] Filed: Sep. 6, 1994

[51] Int. Cl.[6] ..... A46B 11/02; A46B 11/06

[52] U.S. Cl. ..... 401/42; 401/43; 401/46; 401/281; 401/290

[58] Field of Search ..... 401/40–47, 281, 401/290, 42, 43, 45, 46

[56] References Cited

U.S. PATENT DOCUMENTS

| | | | |
|---|---|---|---|
| 1,760,018 | 5/1930 | Soss | 401/46 |
| 2,584,631 | 2/1952 | Soss | 401/40 X |
| 2,736,914 | 3/1956 | Ratliff | 401/281 |
| 3,271,809 | 9/1966 | Morawski | 401/42 |
| 3,619,074 | 11/1971 | Morawski | 401/46 |
| 4,961,662 | 10/1990 | Chow et al. | 401/42 |
| 5,094,558 | 3/1992 | Chu | 401/42 |

FOREIGN PATENT DOCUMENTS

| | | | |
|---|---|---|---|
| 509698 | 3/1952 | Belgium | 401/46 |

*Primary Examiner*—Steven A. Bratlie

*Attorney, Agent, or Firm*—Merchant, Gould, Smith, Edell, Welter & Schmidt

[57] ABSTRACT

A cleaning apparatus includes a body defining a water conduit in an underside thereof for receiving water therein, a cleaning member mounted on an underside of the body for cleaning articles and communicating with the water conduit, a cap mounted on an upperside of the body for sealing the body, a chamber being defined between the cap and the body with an amount of cleaning agent contained therein, and a cleaning agent dispensing device mounted on the body within the chamber for controlling the cleaning agent in the chamber to flow into the water conduit of the body to mix with the water therein.

5 Claims, 5 Drawing Sheets

CLEANING APPARATUS WITH A CLEANING AGENT DISPENSING DEVICE

BACKGROUND OF THE INVENTION

FIELD OF INVENTION

The present invention relates to a cleaning apparatus, and more particularly to cleaning apparatus with a cleaning agent dispensing device.

RELATED PRIOR ART

Very often, people use a cleaning brush cooperating with cleaning agent/water mixture in a barrel to clear dust and contaminants on articles such as the bodies of bicycles, motorcycles, automobiles etc. However, in this manner, it is not easy to determine and control the quantity of the cleaning agent/water mixture in the barrel required to clear the dust and contaminants. In addition, the user has to lift the barrel which may be heavy to pour cleaning agent/water mixture therein onto the articles so as to clear the dust and contaminants, so easily causing injury to the human body, especially having a tendency to cause back pain and injury.

The present invention has arisen to mitigate and/or obviate the above-mentioned disadvantages of the conventional cleaning apparatus.

SUMMARY OF THE INVENTION

The primary objective of the present invention is to provide a cleaning apparatus which functions to clear dust and contaminants out of articles by means of water mixed with cleaning agent or by means of water only.

In accordance with one aspect of the present invention, there is provided a cleaning apparatus comprising a body defining a water conduit in an underside thereof for receiving water therein, a cleaning member mounted on an underside of the body for cleaning articles and communicating with the water conduit, a cap mounted on an upperside of the body for sealing the body, a chamber being defined between the cap and the body with an amount of cleaning agent contained therein, and a cleaning agent dispensing device mounted on the body within the chamber for controlling the cleaning agent in the chamber to flow into the water conduit of the body to mix with the water therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
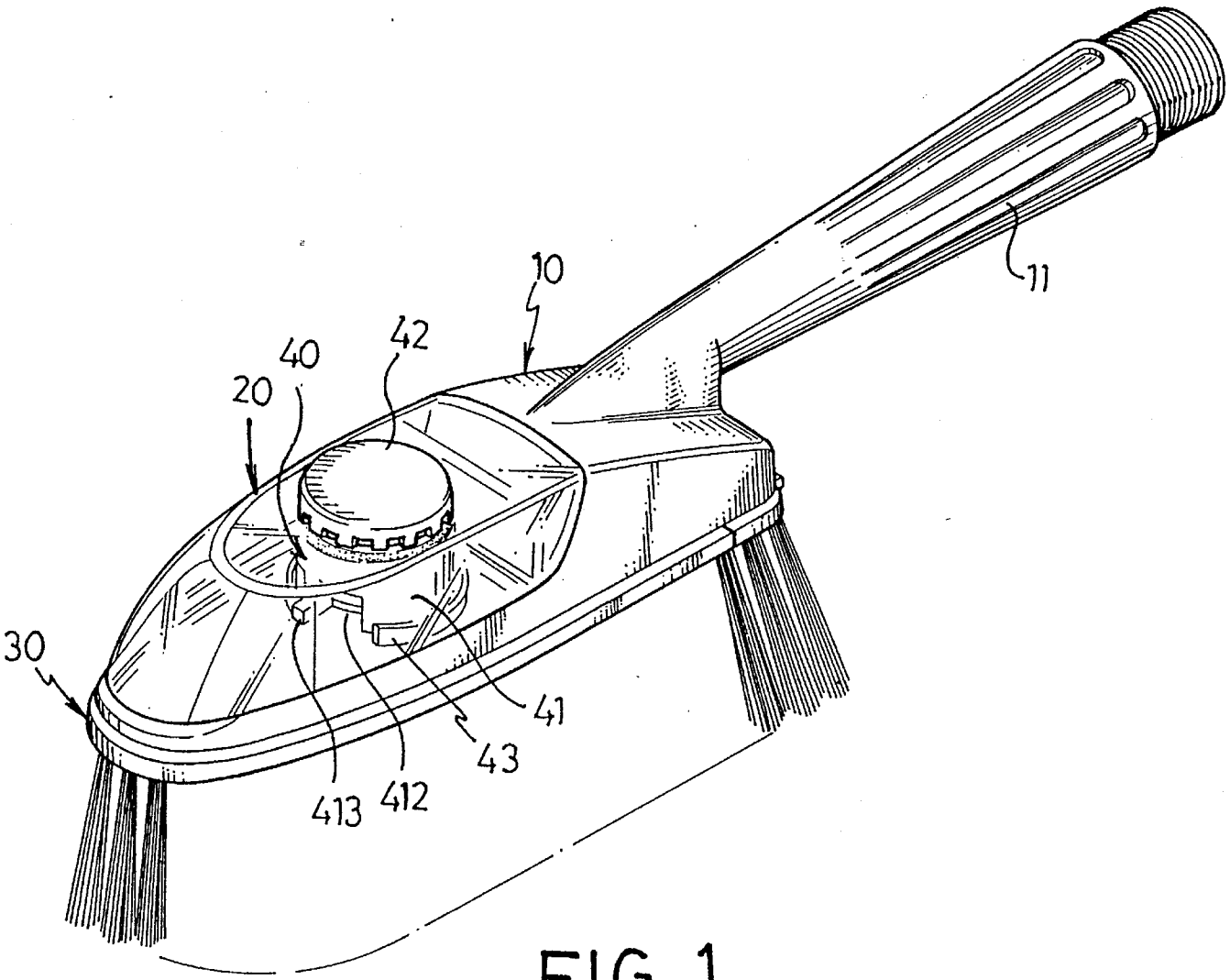
FIG. 1 is a perspective view of a cleaning apparatus in accordance with the present invention.
Figure 2:
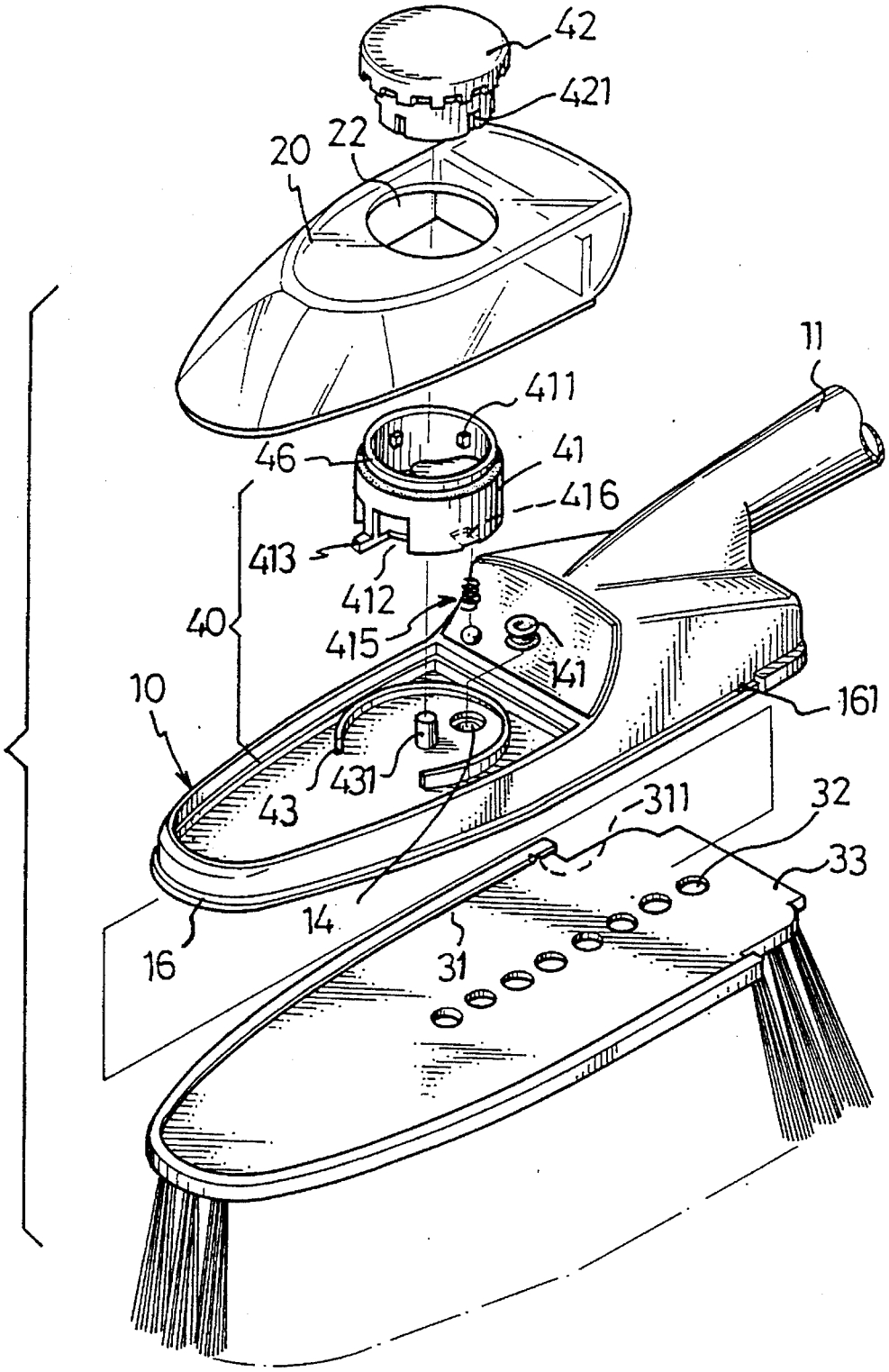
FIG. 2 is an exploded view of the cleaning apparatus as shown in FIG. 1.
Figure 3:
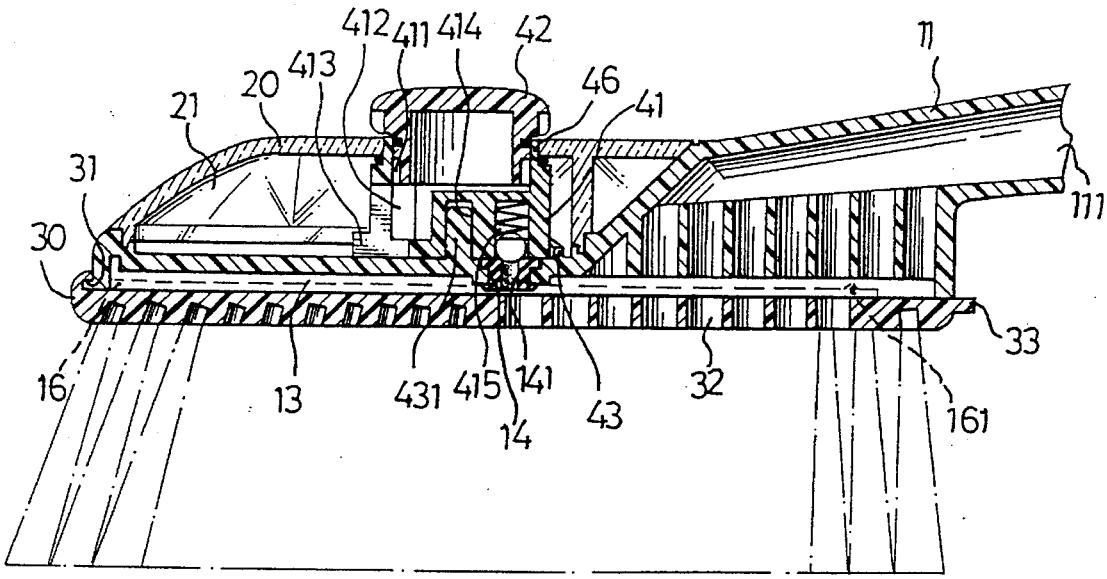
FIGS. 3 is cross-sectional side view of the cleaning apparatus as shown in FIG. 1.

Referring to the drawings, and initially to FIGS. 1–3, a cleaning apparatus in accordance with the present invention comprises a body 10 defining a water conduit 13 in an underside thereof for receiving water therein, a cleaning member 30 mounted on an underside of the body 10 for cleaning articles and communicating with the water conduit 13, a handle portion 11 having a water inlet port 111 therein for communicating with the water conduit 13 so as to convey water from a water source (not shown) outside of the handle portion 11 into the water conduit 13, a cap 20 mounted on an upperside of the body 10 for sealing the body 10, a chamber 21 defined between the cap 20 and the body 10 with an amount of cleaning agent contained therein, a cleaning agent dispensing device 40 mounted on the body 10 within the chamber 21 for controlling amount of the cleaning agent in the chamber 21 to flow into the water conduit 13 of the body 10 to mix with the water therein, a plug 42 mounted on the cap 20 and engaged with the cleaning agent dispensing device 40.

Referring to FIGS. 2 and 3, the body 10 has a shoulder 16 protruding outwardly along a peripheral portion of an underside thereof, a groove 31 defined in a peripheral portion of the cleaning member 30 for receiving the shoulder 16 therein so as to attach the cleaning member 30 to the body 10, a pair of substantially V-shaped snapping members 161 respectively formed on two distal ends of the shoulder 16, a pair of notches 311 defined in the cleaning member 30 each for respectively locking a corresponding one of the pair of snapping members 161 therein to prevent the cleaning member 30 from disengaging with the body 10, a pressing portion 33 formed on a distal end of the cleaning member 30 is able to be pushed by a user, thereby conveniently detaching the cleaning member 30 from the body 10. The cleaning member 30 has a plurality of water outlet ports 32 therein for communicating with the water conduit 13 of the body 10, a plurality of brushes (not labeled) are mounted on an underside of the cleaning member 30.

The cap 20 defines a hole 22 in an upperside thereof, the cleaning agent dispensing device 40 comprises a pivot frame 41 mounted in the chamber 21 and pivotally engaged on the body 10, the pivot frame 41 comprises a top portion (not labeled) abutting against the upperside of the cap, a shoulder 46 protruding upwardly from a peripheral portion of the top portion of the pivot frame 41 and received in and flush with the hole 22, a plurality of flanges 411 protruding radially and inwardly from a peripheral portion of the pivot frame 41, plug 42 has a plurality of cavities 421 defined in a peripheral portion thereof for respectively receiving associated flanges 411 therein so as to engage with the pivot frame 41 thereby sealing the hole 22 in the cap 20, two recesses 412 defined in a peripheral portion of the pivot frame 41 for communicating between the chamber 21 and the pivot frame 41, whereby, when the plug 42 is removed, the cleaning agent is able to be poured into the chamber 21 through the recesses 412 of the pivot frame 41.

Figure 4:
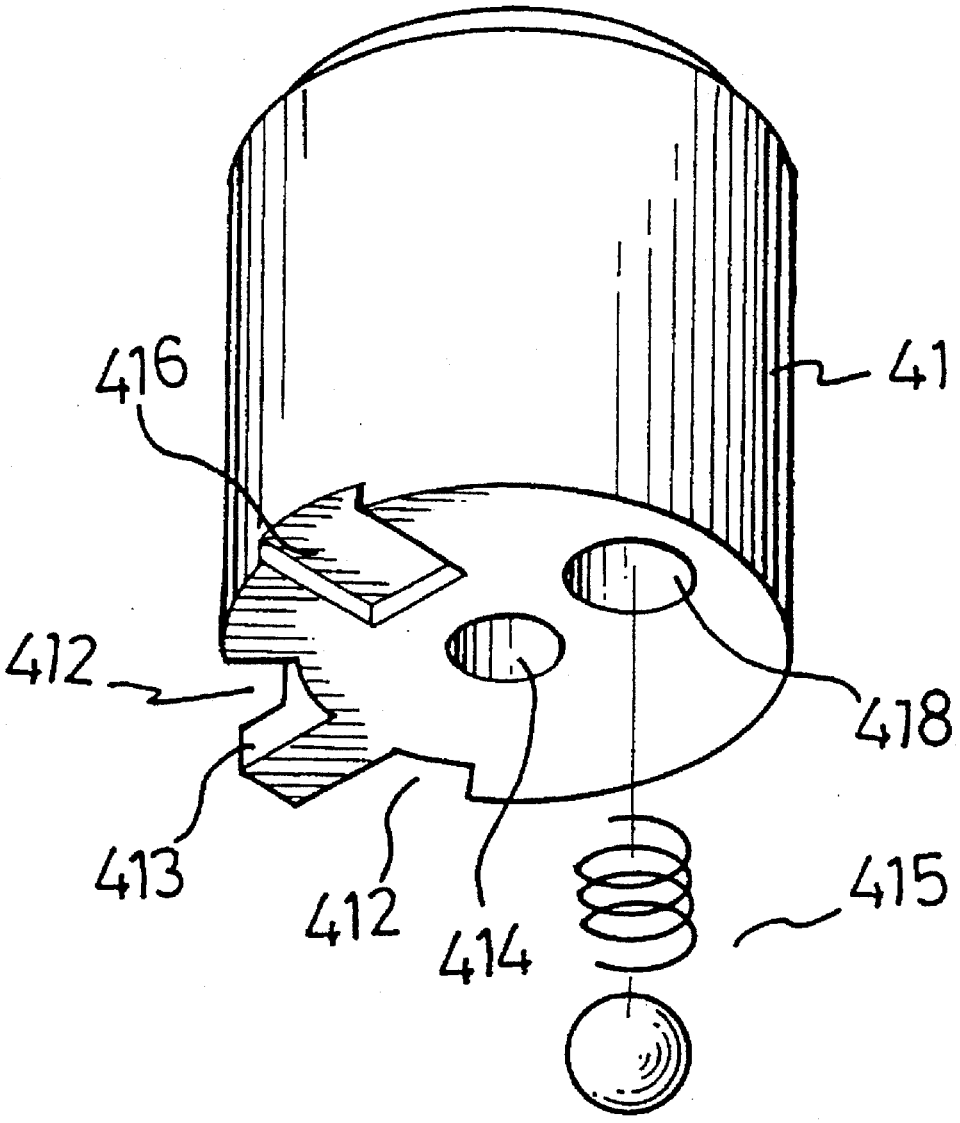
FIG. 4 is a perspective bottom view of a cleaning agent dispensing device.
Figure 5:
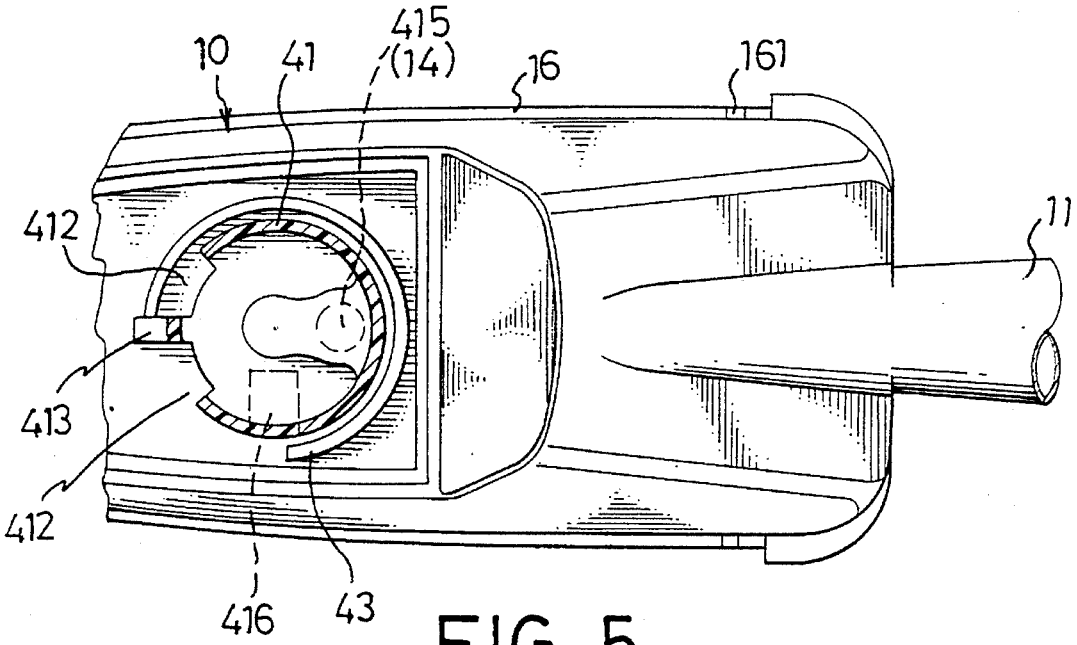
FIG. 5 is a top plan operational view showing the cleaning agent dispensing device in an "OFF" status.
Figure 6:
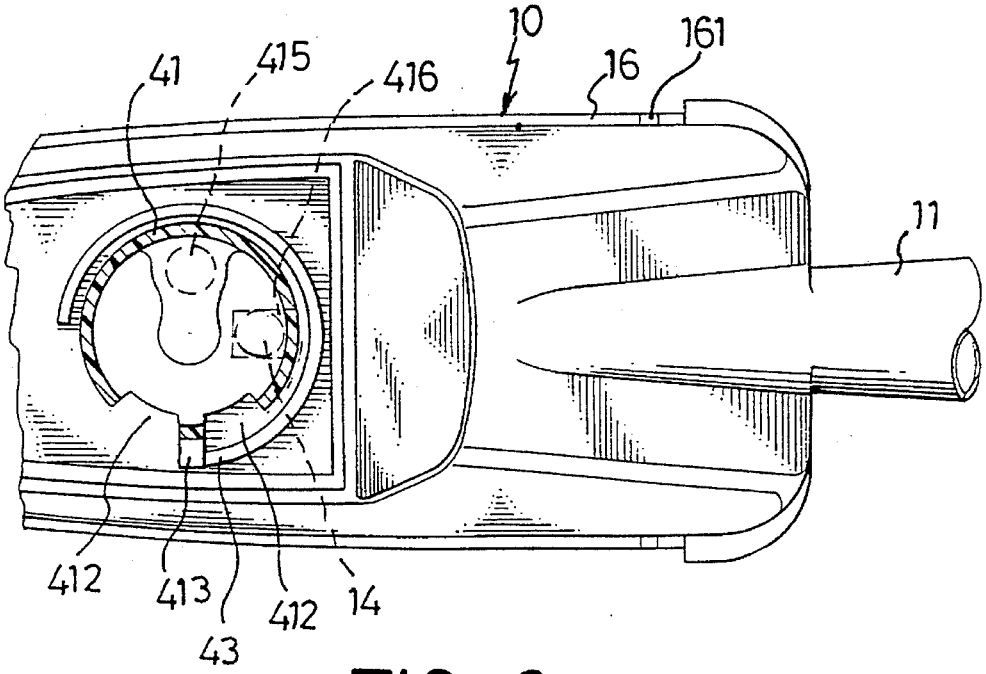
FIG. 6 is a top plan operational view showing the cleaning agent dispensing device in an "ON" status.

The body 10 further defines a passage 14 therein which communicates between the chamber 21 and the water conduit 13, and a pivot axle 431 is fixed on the body 10 adjacent to the passage 14. Referring to FIGS. 4–6, and firstly to FIG. 4, a hole 414 is defined in a central portion of an underside of the pivot frame 41 for receiving the pivot axle 431 therein such that the pivot frame 41 is able to rotate about the pivot axle 431 by means of rotating the plug 42, a compartment 418 is defined in the underside of the pivot frame 41, a biasing member 415 comprises a ball (not labeled) mounted in the compartment 418 and releasably engaged in the passage 14 and a spring (not labelled) mounted in the compartment 418 for biasing against the ball, a depression 416 defined in the underside of the pivot frame 41 and communicating with the chamber 21, whereby, the pivot frame 41 is pivoted between a first position where the biasing member 415 isolates the passage 14 such that the cleaning agent in the chamber 21 is prevented from entering into the water conduit 13 via the passage 14 (see FIG. 5), and a second position where the depression 416 aligns and communicates with the passage 14 such that the cleaning agent in the chamber 21 is able to be released through the passage 14 into the water conduit 13 to mix with water therein (see FIG. 6).

Again referring to FIG. 2, the cleaning agent dispensing device 40 further comprises a C-shaped stop 43 which is mounted on the body 10 and enclosed around the pivot frame 41 and has a first and second free ends (not labeled) with an opening (not labeled) defined therebetween. With reference to FIGS. 5 and 6, a lug portion 413 protrudes from a periphery of the pivot frame 41 between the two recesses 412, the lug portion 413 is pivoted with the pivot frame 41 and is limited to displace in the opening between a first location where the lug portion 413 abuts against the first free end of the C-shaped stop 43 while the pivot frame 41 is at the first position thereof (see FIG. 5), and a second location where the lug portion 413 abuts against the second free end of the C-shaped stop 43 when the pivot frame 41 is at the second position thereof (see FIG. 6). In this manner, when the plug 42 is rotated clockwise, the pivot frame 41 is rotated therewith until the lug portion 413 is retarded by the first free end of the stop 43 while the biasing member 415 isolates the passage 14, so interfering with the cleaning agent in the chamber 21 from entering into the water conduit 13 (see FIG. 5), at this point, we define the cleaning agent dispensing device 40 to be at an "OFF" status. Preferably, a gasket 141 (see FIG. 3) is mounted in the passage 14 to increase the sealing effect of the biasing member 415. Conversely, when the plug 42 is rotated counterclockwise, the pivot frame 41 is rotated therewith until the lug portion 413 is retarded by the second free end of the stop 43 while the depression 416 aligns and communicates with the passage 14, so releasing the cleaning agent in the chamber 21 into the water conduit 13 (see FIG. 6), at this point, we define the cleaning agent dispensing device 40 to be at an "ON" status. Then, water mixed with the cleaning agent is introduced through the plurality of water outlet ports 32 into the cleaning member 30 so as to cooperate with the brushes to clear dust or contaminants on the articles.

It should be clear to those skilled in the art that further embodiments of the present invention may be made without departing from the teachings of the present invention.

What is claimed is:

1. A cleaning apparatus comprising:

a body (10) defining a water conduit (13) in an underside thereof for receiving water therein, a passage (14) vertically defined in said body (10);

a cleaning member (30) mounted on an underside of said body (10) for cleaning articles and communicating with said water conduit (13);

a cap (20) mounted on an upperside of said body (10) for sealing said body (10) and including a hole (22) defined in an upperside thereof, a chamber (21) being defined between said cap (20) and said body (10) with an amount of cleaning agent contained therein, said passage (14) communicating between said chamber (21) and said water conduit (13); and a cleaning agent dispensing device (40) mounted on said body (10) within said chamber (21) for controlling said cleaning agent in said chamber (21) to flow into said water conduit (13) of said body (10) to mix with the water therein, said cleaning agent dispensing device (40) comprising a pivot frame (41) mounted in said chamber (21) and pivotally engaged on said body (10), said pivot frame (41) having a top portion received in said hole (22) of said cap (20) and comprising a plurality of flanges (411) protruding radially and inwardly from a peripheral portion thereof a plug (42) including a plurality of cavities (421) defined in a peripheral portion thereof for receiving and engaging associated flanges (411) therein such that said plug acts as a knob for manually pivoting said pivot frame, said plug removably sealing said hole (22) in said cap (20); at least one passage (412) defined in a peripheral portion of said pivot frame (41) for communicating between said chamber (21) and said pivot frame (41) to allow refilling of said chamber (21) with cleaning agent introduced through said hole (22), a compartment (418) defined in an underside of said pivot frame (41) a biasing member (415) comprising a ball disposed in said compartment (418) and releasably engaged with an end of said passage (14) of said body (10) to seal said passage, and a spring mounted in said compartment (418) for urging said ball to seal said passage (14) a depression (416) defined in an underside of said pivot frame (41) and communicating with said chamber (21), whereby, said pivot frame (41) is pivoted via pivotal manipulation of said plug between a first position where said ball of said biasing member (415) isolates said passage (14) such that said cleaning agent in said chamber (21) is prevented from entering into said water conduit (13) via said passage (14), and a second position where said ball of said biasing member (415) is disengaged from said passage (14) and said depression (416) communicates with said passage (14) such that said cleaning agent in said chamber (21) is released through said passage (14) into said water conduit (13) to mix with water therein.

2. The cleaning apparatus in accordance with claim 1, wherein said cleaning agent dispensing device (40) further comprises a C-shaped stop (43) which is mounted on said body (10) and has a first and second free ends with an opening defined therebetween, a lug portion (413) protrudes from a periphery of said pivot frame (41) to pivot therewith and is limited to displace in said opening between a first location where said lug portion (413) abuts against the first free end of said C-shaped stop (43) while said pivot frame (41) is at said first position thereof, and a second location where said lug portion (413) abuts against the second free end of said C-shaped stop (43) while said pivot frame (41) is at said second position thereof.

3. The cleaning apparatus in accordance with claim 1, wherein said body (10) has a shoulder (16) protruding outwardly along a peripheral portion of the underside thereof, a groove (31) defined in a peripheral portion of said cleaning member (30) for slidably receiving said shoulder (16) therein so as to attach said cleaning member (30) to said body (10), a pair of substantially V-shaped snapping members (161) respectively formed on two distal ends of said shoulder (16), a pair of notches (311) defined in said cleaning member (30) for respectively locking associated said pair of snapping members (161) therein to prevent said cleaning member (30) from disengaging with said body (10), a pressing portion (33) formed on a distal end of said cleaning member (30) for convenience in disengaging said snapping members from said notches such that said cleaning member may be slidably emoved from said body.

4. The cleaning apparatus in accordance with claim 1, wherein said body further comprises a handle portion (11) which has a water inlet port (111) for communicating with said water conduit (13) so as to convey water from outside into said water conduit (13).

5. The cleaning apparatus in accordance with claim 4, wherein said cleaning member (30) has a plurality of water outlet ports (32) therein for communicating with said water conduit (13), a plurality of brushes are mounted on an underside of said cleaning member (30).

* * * * *